US008899298B2

(12) United States Patent
Hsueh Cheng

(10) Patent No.: US 8,899,298 B2
(45) Date of Patent: Dec. 2, 2014

(54) WINDOW TREATMENT ROLL-UP DEVICE

(71) Applicant: Mei-Chin Hsueh Cheng, Changhua Hsien (TW)

(72) Inventor: Mei-Chin Hsueh Cheng, Changhua Hsien (TW)

( * ) Notice: Subject to any disclaimer, the term of this patent is extended or adjusted under 35 U.S.C. 154(b) by 0 days.

(21) Appl. No.: 13/759,737

(22) Filed: Feb. 5, 2013

(65) Prior Publication Data

US 2014/0216667 A1 Aug. 7, 2014

(51) Int. Cl.

*E06B 9/322* (2006.01)
*E06B 9/80* (2006.01)
*E06B 9/84* (2006.01)

(52) U.S. Cl.

CPC . *E06B 9/80* (2013.01); *E06B 9/322* (2013.01); *E06B 9/84* (2013.01); *E06B 2009/807* (2013.01)

USPC ..... 160/170; 160/192; 160/191

(58) Field of Classification Search

USPC ..... 160/168.1 R, 170, 173 R, 178.1 R, 178.2, 160/192

See application file for complete search history.

(56) References Cited

U.S. PATENT DOCUMENTS 3,451,463 A * 6/1969 Lyman ..... 160/23.1
5,054,162 A * 10/1991 Rogers ..... 16/198
5,133,399 A * 7/1992 Hiller et al. ..... 160/171
5,482,100 A * 1/1996 Kuhar ..... 160/170
6,149,094 A * 11/2000 Martin et al. ..... 242/373
6,234,236 B1 * 5/2001 Kuhar ..... 160/170
6,283,192 B1 * 9/2001 Toti ..... 160/170
6,289,965 B1 * 9/2001 Ruggles ..... 160/170
6,318,661 B1 * 11/2001 Martin et al. ..... 242/373
6,325,131 B1 * 12/2001 Dekker et al. ..... 160/170
6,330,899 B1 * 12/2001 Ciuca et al. ..... 160/170
6,508,293 B1 * 1/2003 Huang ..... 160/170
6,571,853 B1 * 6/2003 Ciuca et al. ..... 160/170
6,601,635 B2 * 8/2003 Ciuca et al. ..... 160/170
6,644,375 B2 * 11/2003 Palmer ..... 160/170
6,761,203 B1 * 7/2004 Huang ..... 160/170
6,823,925 B2 * 11/2004 Militello et al. ..... 160/170
6,837,294 B2 * 1/2005 Cheng et al. ..... 160/84.04
6,889,741 B1 * 5/2005 Cheng et al. ..... 160/170
6,957,683 B2 * 10/2005 Toti ..... 160/170
6,962,187 B2 * 11/2005 Gilmore et al. ..... 160/170
7,093,644 B2 * 8/2006 Strand ..... 160/170
7,168,476 B2 * 1/2007 Chen ..... 160/170
7,311,133 B2 * 12/2007 Anderson et al. ..... 160/170
7,311,134 B2 * 12/2007 Cheng ..... 160/173 R
7,398,815 B2 * 7/2008 Liang ..... 160/170
7,406,995 B2 * 8/2008 Huang ..... 160/170
7,487,817 B2 * 2/2009 Liang ..... 160/170

(Continued)

*Primary Examiner* — Katherine Mitchell
*Assistant Examiner* — Johnnie A Shablack
(74) *Attorney, Agent, or Firm* — Che-Yang Chen; Law Office of Michael Chen

(57) ABSTRACT

A window treatment roll-up device has: a support base, a rotation base, at least two power springs, a braking member and a control wheel. The support base comprises a first shaft, a second shaft, a third shaft and a fourth shaft, the third shaft and the fourth shaft are engaged with each other, a controlling rope wrapped around the second shaft, the rotation base is jacketed onto the second shaft. The control wheel is disposed on the fourth shaft and configured to be wrapped by a rolling rope. The braking member has a first end and a second end, the first end is tapered such that the braking member is cone-shaped; a spiral slot connecting between the first end and the second end is disposed on a surface of the braking member. The first end of the braking member and the power spring both jacket onto the third shaft.

3 Claims, 8 Drawing Sheets

(56) References Cited

U.S. PATENT DOCUMENTS

| | | | | |
|---|---|---|---|---|
| 7,575,036 | B2 * | 8/2009 | Cheng | 160/170 |
| 7,717,154 | B2 * | 5/2010 | Cheng | 160/170 |
| 7,866,367 | B2 * | 1/2011 | Liang et al. | 160/173 R |
| 7,886,803 | B2 * | 2/2011 | Anderson et al. | 160/170 |
| 7,984,745 | B2 * | 7/2011 | Wen et al. | 160/170 |
| 8,291,959 | B2 * | 10/2012 | Cheng | 160/84.01 |
| 8,297,332 | B2 * | 10/2012 | Lin | 160/170 |
| 2004/0177933 | A1 * | 9/2004 | Hillman et al. | 160/170 |
| 2007/0119547 | A1 * | 5/2007 | Liang | 160/170 |
| 2007/0163727 | A1 * | 7/2007 | Cheng et al. | 160/170 |
| 2007/0261798 | A1 * | 11/2007 | Hung et al. | 160/170 |
| 2008/0000592 | A1 * | 1/2008 | Huang | 160/170 |
| 2008/0185109 | A1 * | 8/2008 | Lin | 160/170 |
| 2009/0120593 | A1 * | 5/2009 | Lesperance | 160/84.02 |
| 2011/0290429 | A1 * | 12/2011 | Cheng | 160/84.02 |
| 2012/0118515 | A1 * | 5/2012 | Chen | 160/170 |
| 2013/0248125 | A1 * | 9/2013 | Lin | 160/84.05 |
| 2013/0306248 | A1 * | 11/2013 | Toti | 160/84.05 |

* cited by examiner

WINDOW TREATMENT ROLL-UP DEVICE

BACKGROUND OF THE INVENTION

1. Field of the Invention

The present invention relates to a window treatment roll-up device, and more particularly to a window treatment roll-up device for securing window treatments.

2. Description of the Related Art

Currently, typical window treatment roll-up device 60, as shown in FIG. 7 and FIG. 8, comprises a pair of casings 61, a first shaft 611 disposed between the casings 61, two second shafts 612 respectively disposed at two sides of the first shaft 611, the first shaft 611 and the two second shafts 612 are configured to be jacketed by a rotation base 62 and two power springs 63, one end of the power spring 63 is attached onto a rolling surface 621 of the rotation base 62, such that the rotation base 62 and the two power springs 63 are capable of interacting with each other. The rotation base 62 further has a rolling wheel 622 with a V-shaped slot. The rolling wheel 622 is configured for being wrapped with a pulling rope 64, the pulling rope 64 passes guiding wheel 71, wraps around a control rod 72 of a support beam 70 and is attached onto a pulling rope 73.

The power spring 63 controls the rotation base 62, the rotation base 62 pulls out the power spring 63 to be wrapped around rolling surface 621.

However, the above mentioned structure has following drawback: The window treatment roll-up device 60 utilizes a ratio between the weight of the power spring 63 and the weight of the window treatment to control the height of the window treatment. But the rolled up window treatment might drop down by accident or have dramatic movements very often.

Therefore, it is desirable to provide a window treatment roll-up device to mitigate and/or obviate the aforementioned problems.

SUMMARY OF THE INVENTION

An objective of the present invention is to provide a window treatment roll-up device.

In order to achieve the above mentioned objective, a window treatment roll-up device comprises: a support base, a rotation base, at least two power springs, a braking member and a control wheel. The support base comprises a first shaft, a second shaft, a third shaft and a fourth shaft, the third shaft and the fourth shaft are engaged with each other, a controlling rope wrapped around the second shaft, the rotation base is jacketed onto the second shaft, the power springs are disposed on respective sides of the rotation base and respectively jacketed onto the first shaft and the third shaft; an outer end of each power spring is coupled to the rotation base, such that the at least two power springs are controlled by the rotation base and wrap around the rotation base; the control wheel is disposed on the fourth shaft and configured to be wrapped by a rolling rope. The braking member has a first end and a second end, the first end is tapered such that the braking member is cone-shaped; a spiral slot connecting between the first end and the second end is disposed on a surface of the braking member. The first end of the braking member and the power spring both jacket onto the third shaft, such that the controlling rope is able to be pulled from the second shaft and wrapped around the second end.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
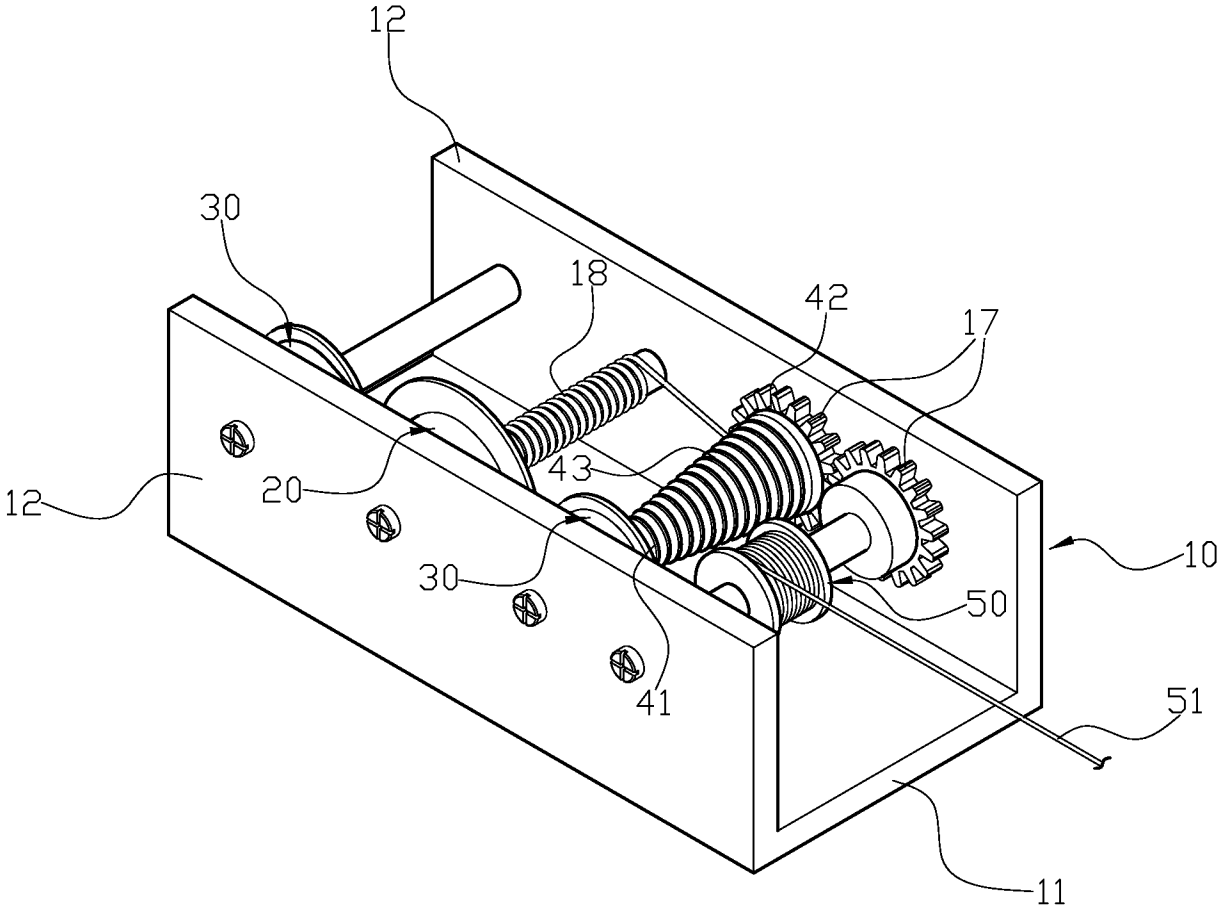
FIG. 1 is a perspective assembly drawing of an embodiment of the present invention.
Figure 2:
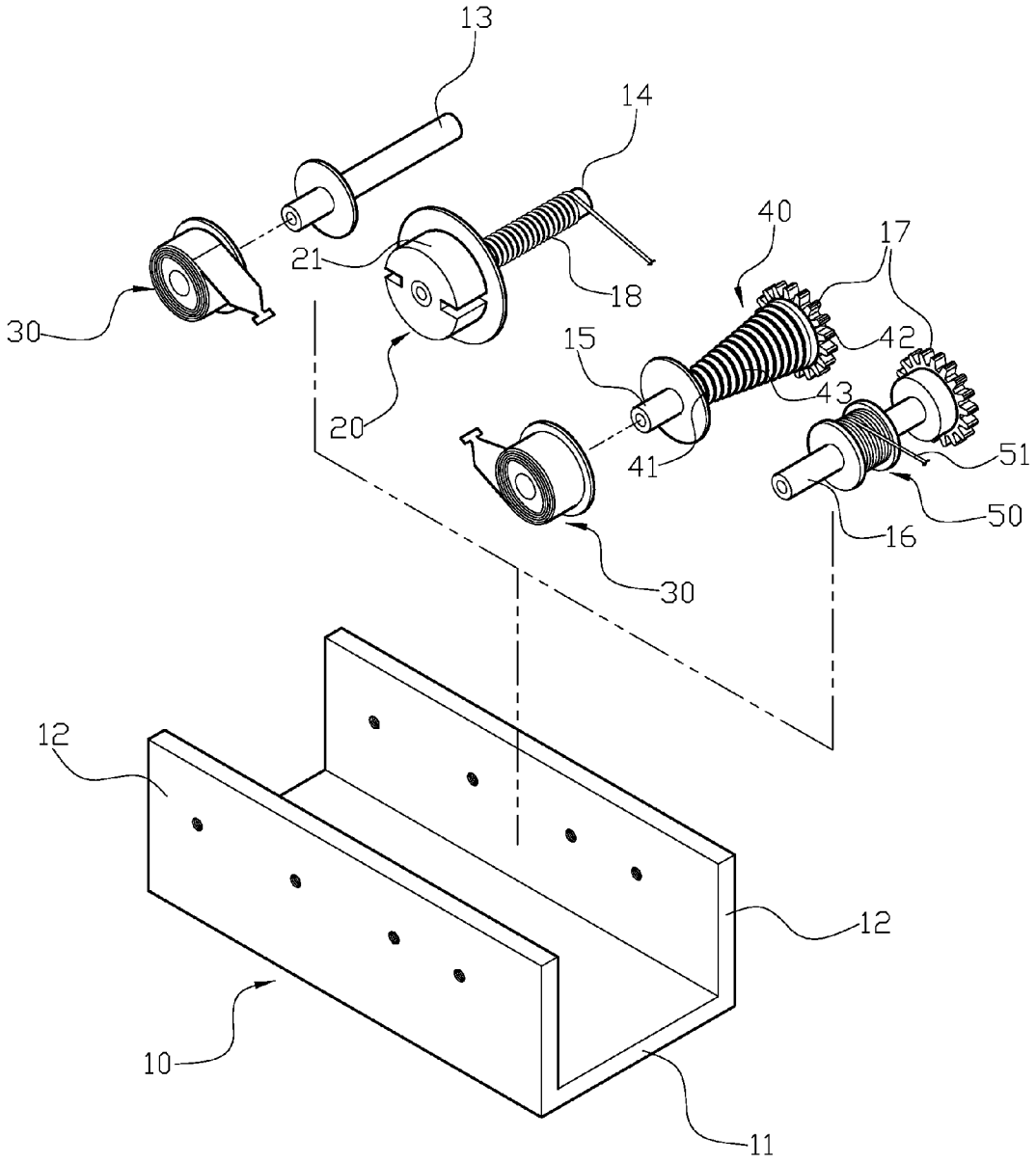
FIG. 2 is a perspective exploded drawing of the embodiment of the present invention.
Figure 3:
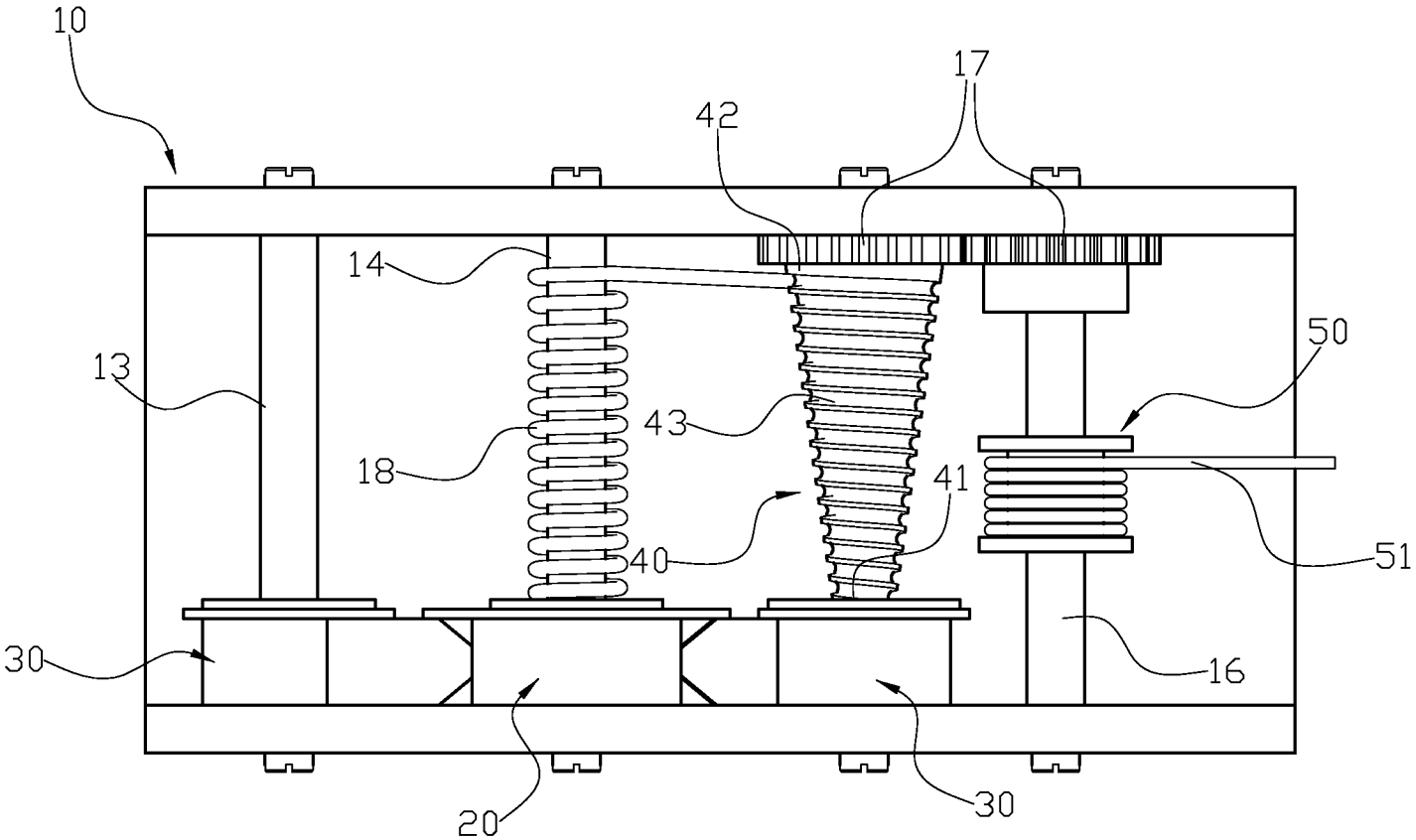
FIG. 3 is schematic drawing of the embodiment of the present invention.
Figure 4:
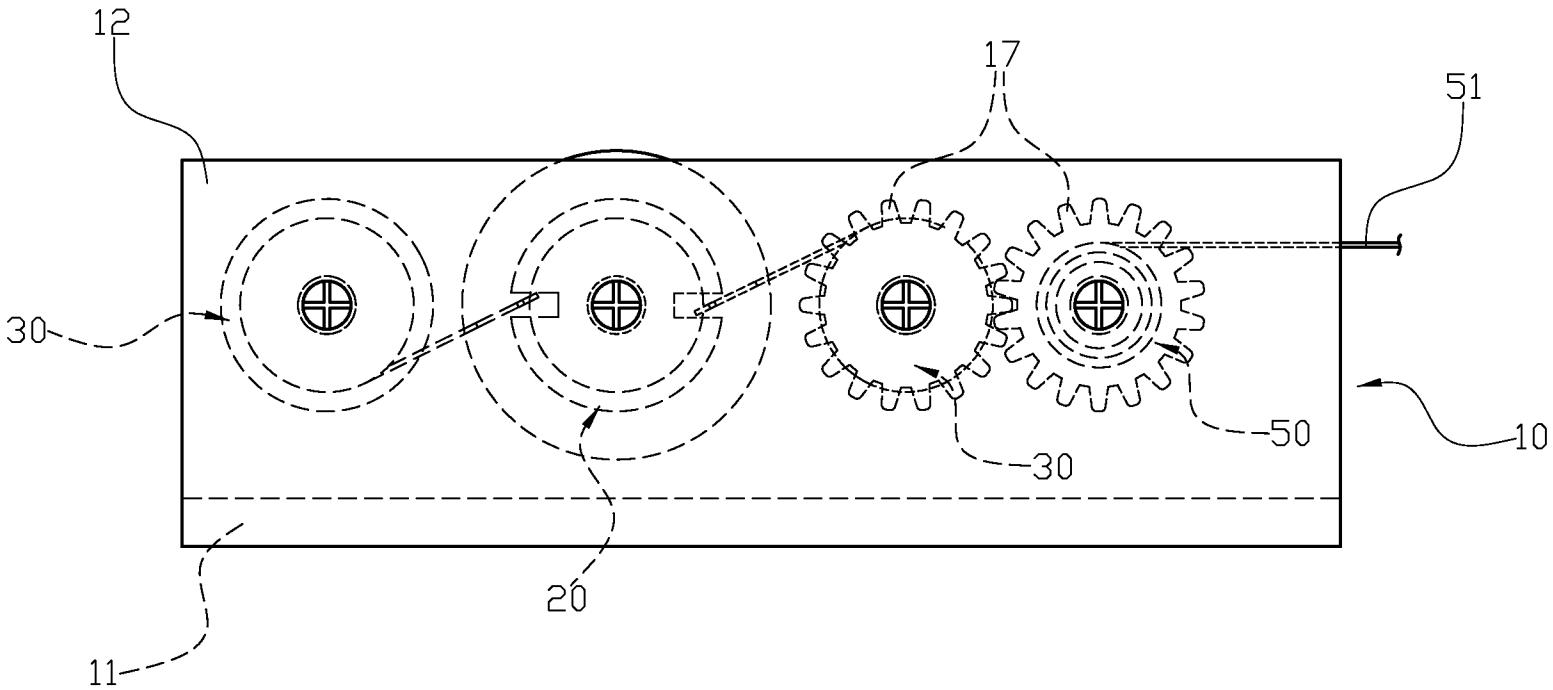
FIG. 4 is another perspective drawing of the embodiment of the present invention.

Please refer to FIG. 1 to FIG. 4. A window treatment roll-up device comprises a support base 10, a rotation base 20, two power springs 30, a braking member 40 and a control wheel 50. The support base 10 has a bottom board 11 and two side boards 12, and a first shaft 13, a second shaft 14, a third shaft 15 and a fourth shaft 16 are disposed between the side boards 12. The third shaft 15 and the fourth shaft 16 are linked by a gear set 17. The second shaft 14 is wrapped around by a controlling rope 18, the rotation base 20 is jacketed onto the second shaft 14, and the power springs 30 are disposed on respective sides of the rotation base 20 and respectively jacketed onto the first shaft 13 and the third shaft 15. An outer end of each power spring 30 is coupled to the rotation base 20, such that the two power springs 30 are controlled by the rotation base 20 and wrap around a rolling surface 21 of the rotation base 20. The braking member 40 has a first end 41 and a second end 42, and the first end 41 is tapered such that the braking member 40 is cone-shaped. A spiral slot 43 connecting between the first end 41 and the second end 42 is disposed on a surface of the braking member 40. The first end 41 of the braking member 40 and the power spring 30 both jacket onto the third shaft 15, such that the controlling rope 18 is able to be pulled from the second shaft 14 and wrapped around the second end 42. The control wheel 50 is disposed on the fourth shaft 16 and configured to be wrapped by a pulling rope 51, and the pulling rope 51 is attached onto the window treatment.

For actual operation, in order to close or open the window treatment, the pulling rope 51 is pulled to make the control wheel 50 to drive the fourth shaft 16 to rotate, with the gear set 17, which drives the third shaft 15, and the braking member 40 controls the controlling rope 18 to drive the second shaft 14. Meanwhile, the power spring 30 is stretched outwardly to wrap around the rotation base 20 to bring up the window treatment; or when the window treatment is leased down, the power spring 30 is released back.

Figure 5:
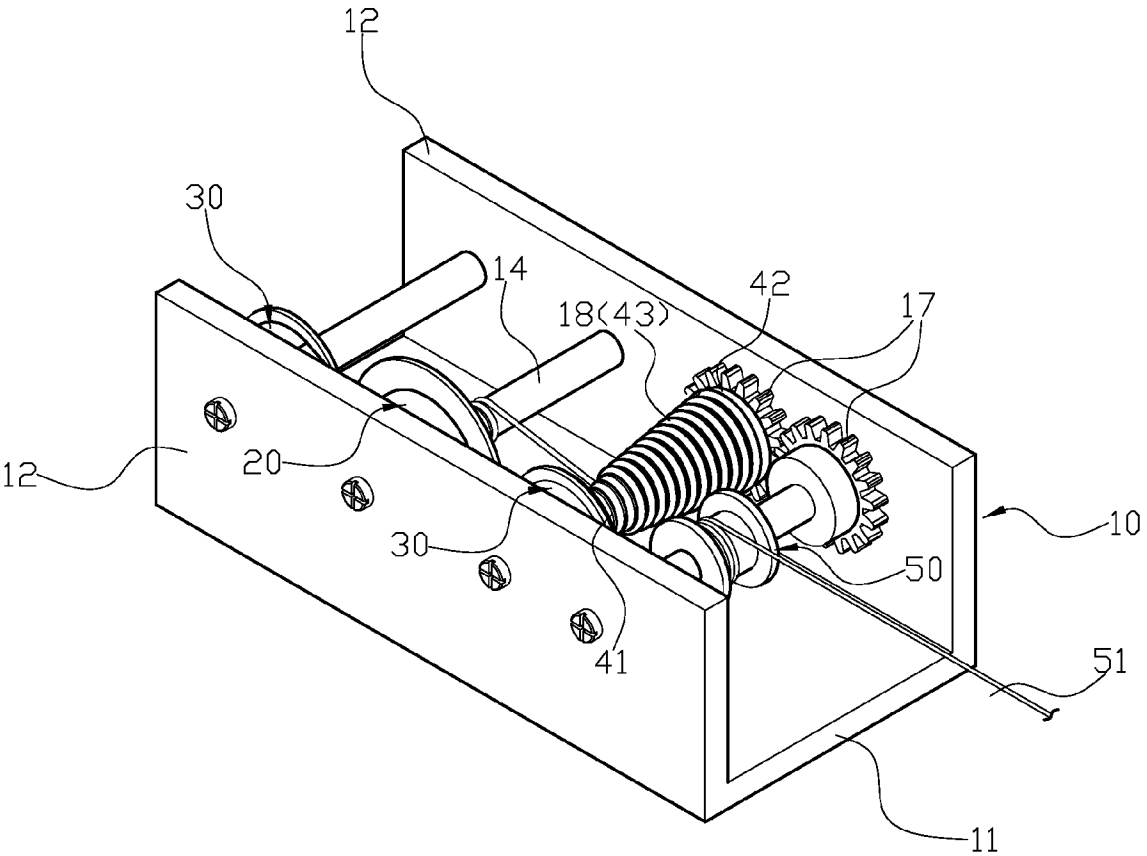
FIG. 5 is a perspective drawing showing the pulling rope being pulled according to the embodiment of the present invention.
Figure 6:
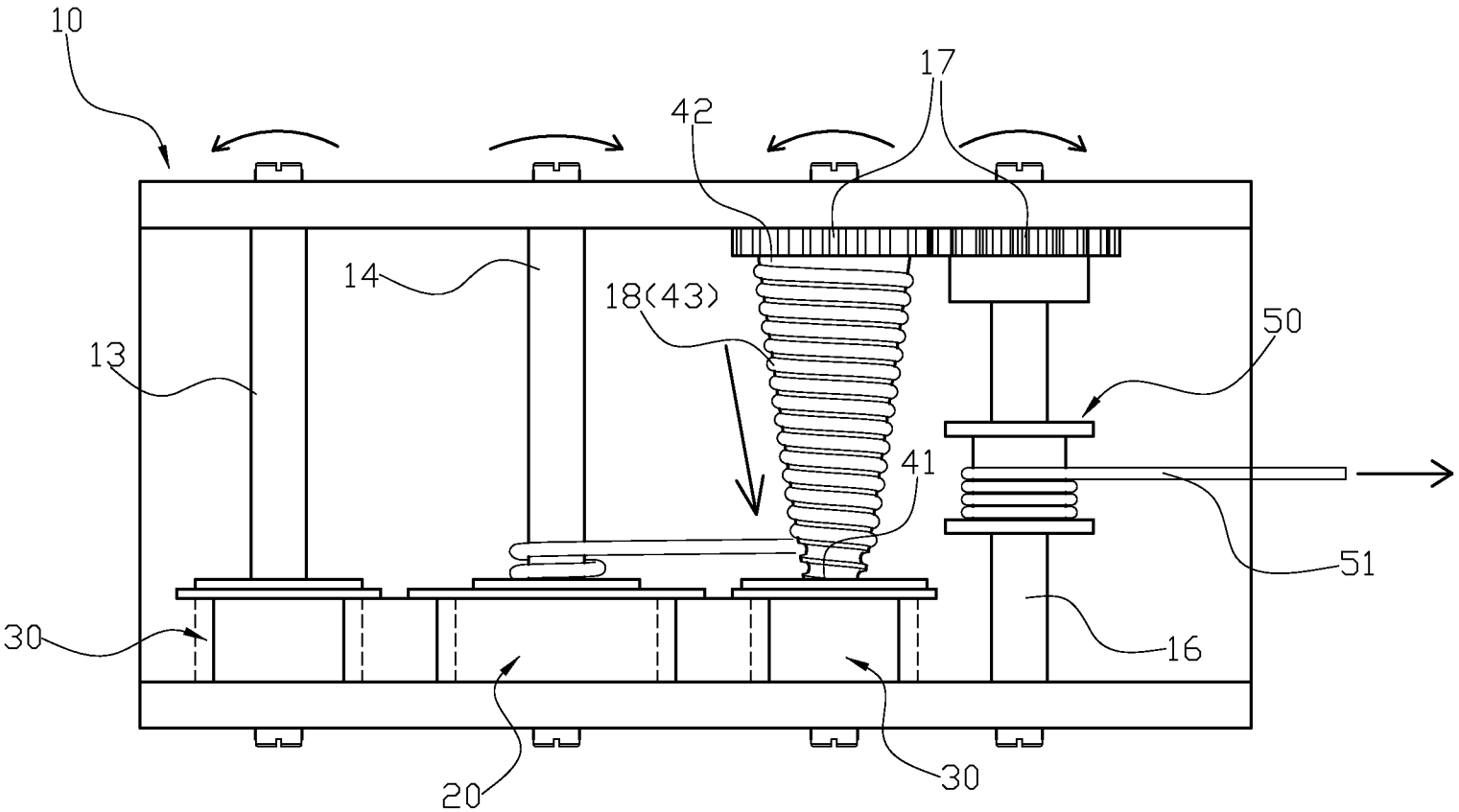
FIG. 6 is top view drawing showing the pulling rope being pulled according to the embodiment of the present invention.
Figure 7:
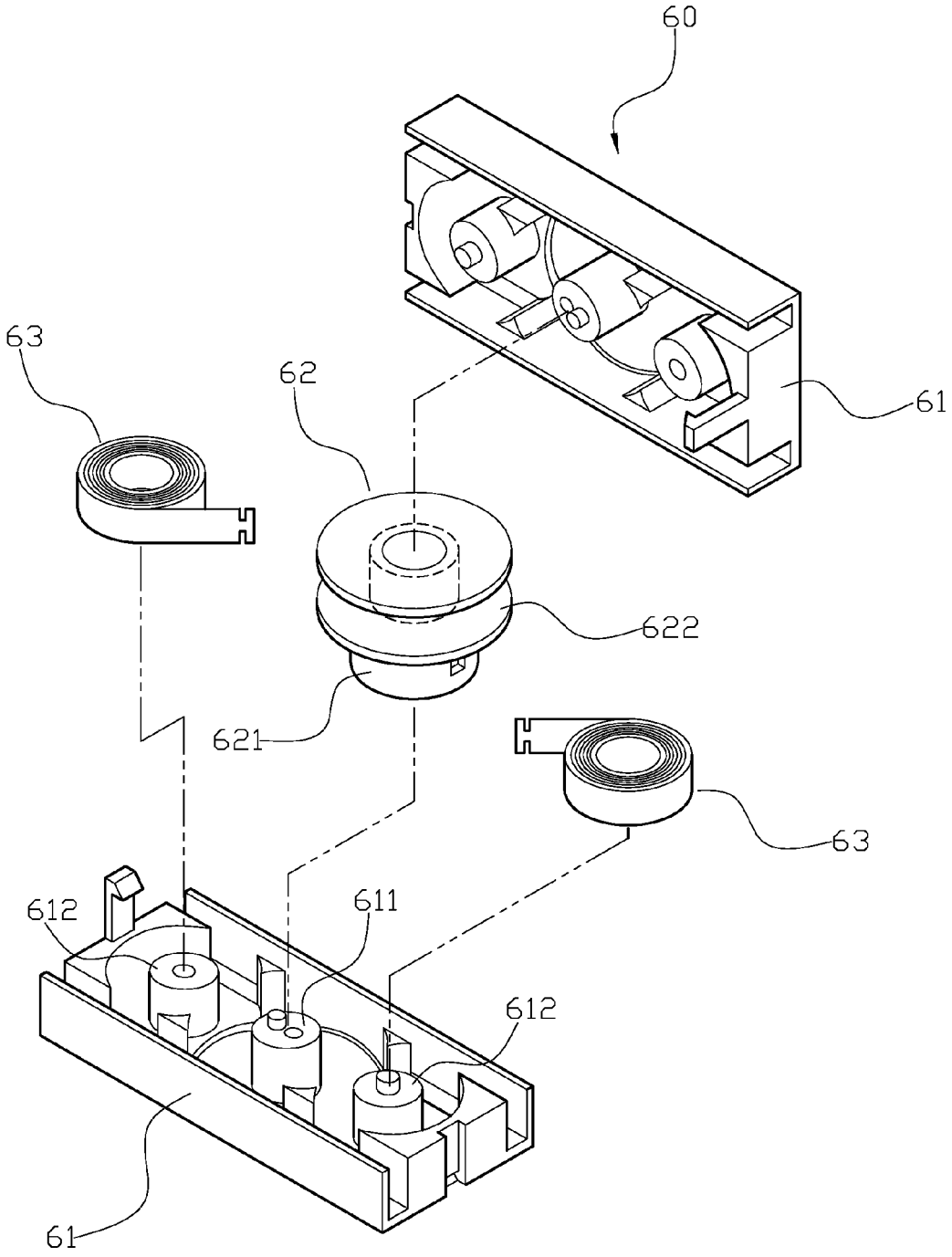
FIG. 7 is a perspective exploded drawing of a prior art device.
Figure 8:
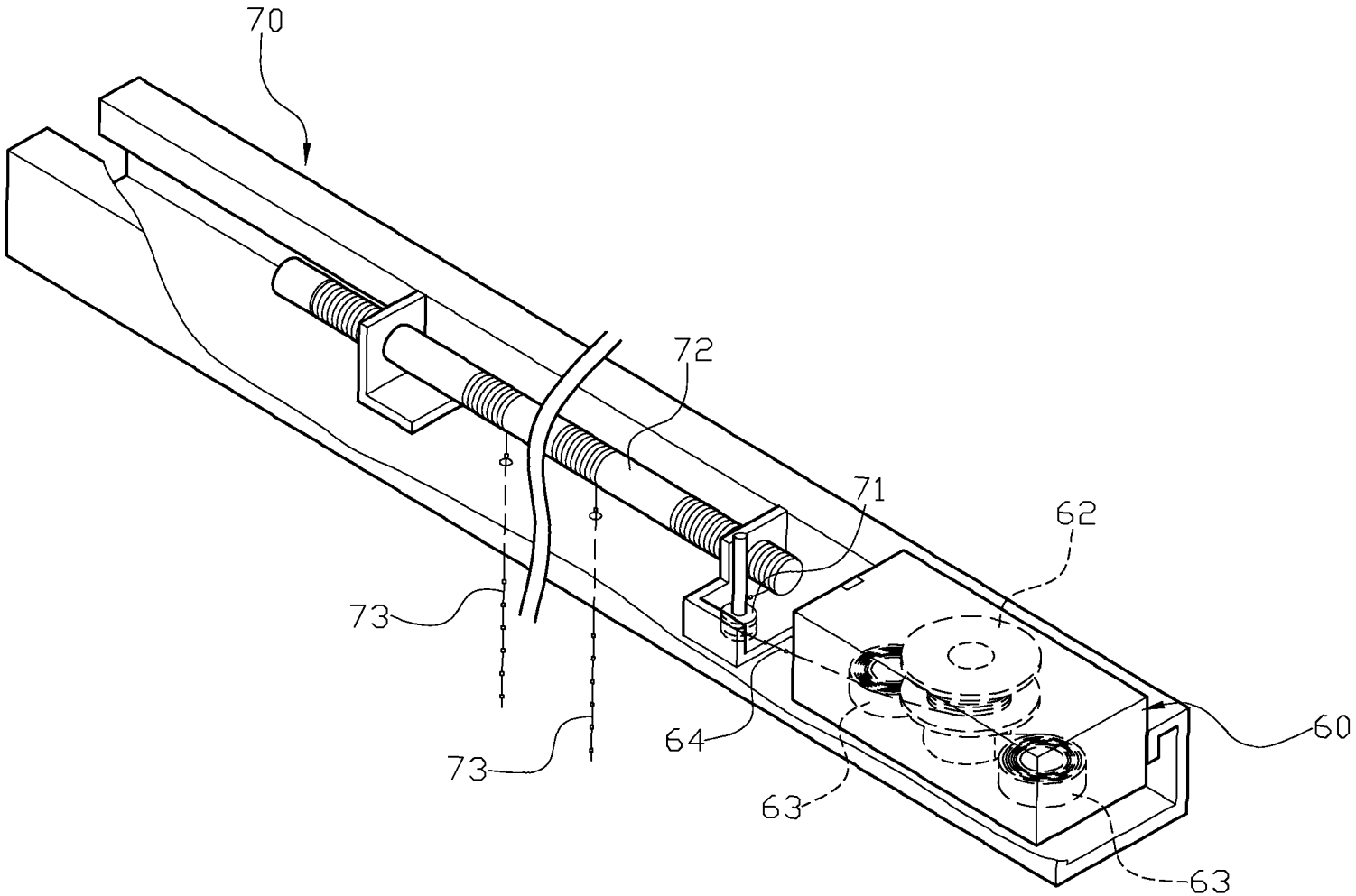
FIG. 8 is a schematic drawing of the prior art device being mounted onto a support beam.

Please refer to FIG. 5 and FIG. 6. The spiral slot 43 helps the controlling rope 18 to be wrapped from the second end 42 to the first end 41, which provides stationary break to prevent the window treatment from dropping or dramatic movements. Since the second end 42 of the braking member 40 is relative larger than the second shaft 14, when the second end 42 rotate one circle, the second shaft 14 needs to rotate two or more circles to incorporate with the braking member 40. But, in order to rotate the second shaft 14, the power spring 30 needs to be wrapped around the rotation base 20, when the second shaft 14 is controlled by the second end 42, the second shaft 14 needs to overcome twice or more times of the elastic strength of the power spring 30, which can prevent the window treatment from dropping or dramatic movements.

Although the present invention has been explained in relation to its preferred embodiment, it is to be understood that many other possible modifications and variations can be made without departing from the spirit and scope of the invention as hereinafter claimed.

What is claimed is:

1. A window treatment roll-up device comprising: a support base, a rotation base, at least two power springs, a braking member and a control wheel;

wherein the support base comprises a first shaft, a second shaft, a third shaft and a fourth shaft, the third shaft and the fourth shaft are engaged with each other, a controlling rope directly wrapped around the second shaft, the rotation base is jacketed onto the second shaft, the power springs are disposed on respective sides of the rotation base and respectively jacketed onto the first shaft and the third shaft; an outer end of each power spring is coupled to the rotation base, such that the at least two power springs are controlled by the rotation base and wrap around the rotation base; the control wheel is disposed on the fourth shaft and configured to be wrapped by a rolling rope; wherein the braking member has a first end and a second end, the first end is tapered such that the braking member is cone-shaped; a spiral slot connecting between the first end and the second end is disposed on a surface of the braking member; the first end of the braking member and one of the power springs both jacket onto the third shaft, such that the controlling rope is pulled from the second shaft and wrapped around the second end, wherein the braking member controls the second shaft through the controlling rope by overcoming elastic strength provided by each power spring on the rotation base.

2. The window treatment roll-up device as claimed in claim 1, wherein the support base has a bottom board and two side boards, and the first shaft, the second shaft, the third shaft and the fourth shaft are disposed between the side boards.

3. The window treatment roll-up device as claimed in claim 1, wherein the third shaft and the fourth shaft are connected by a gear set.

* * * * *